US006876249B2

(12) United States Patent
Maigret et al.

(10) Patent No.: US 6,876,249 B2
(45) Date of Patent: Apr. 5, 2005

(54) CIRCUIT AND METHOD FOR A PROGRAMMABLE REFERENCE VOLTAGE

(75) Inventors: Robert Maigret, Warwick, RI (US); Thomas Somerville, Tempe, AZ (US)

(73) Assignee: Semiconductor Components Industries, LLC, Phoenix, AZ (US)

( * ) Notice: Subject to any disclaimer, the term of this patent is extended or adjusted under 35 U.S.C. 154(b) by 33 days.

(21) Appl. No.: 10/217,497

(22) Filed: Aug. 13, 2002

(65) Prior Publication Data

US 2004/0032293 A1 Feb. 19, 2004

(51) Int. Cl.[7] ..... G05F 1/10

(52) U.S. Cl. ..... 327/539; 327/538; 327/543; 323/315; 323/316

(58) Field of Search ..... 327/539, 540, 327/541, 542, 543; 323/313, 315, 316

(56) References Cited

U.S. PATENT DOCUMENTS 4,313,083 A * 1/1982 Gilbert et al. ..... 323/350
4,380,706 A * 4/1983 Wrathall ..... 327/539
4,810,902 A * 3/1989 Storti et al. ..... 326/89
5,091,888 A * 2/1992 Akaogi ..... 365/185.21
5,335,203 A * 8/1994 Ishii et al. ..... 365/226
5,559,425 A * 9/1996 Allman ..... 323/315
5,917,753 A * 6/1999 Dallabora et al. ..... 365/185.21
5,929,696 A * 7/1999 Lim et al. ..... 327/540
6,121,824 A * 9/2000 Opris ..... 327/539
6,239,652 B1 * 5/2001 Oh et al. ..... 327/541
6,411,158 B1 * 6/2002 Essig ..... 327/539
6,473,340 B1 * 10/2002 Pasotti et al. ..... 365/185.21
6,531,914 B2 * 3/2003 Kawakubo ..... 327/541
6,570,437 B2 * 5/2003 Park et al. ..... 327/539
2003/0058031 A1 * 3/2003 Scoones ..... 327/539

* cited by examiner

*Primary Examiner*—Terry D. Cunningham
(74) *Attorney, Agent, or Firm*—Robert F. Hightower

(57) ABSTRACT

An adjustable voltage reference circuit (14, 25, 70) that can be adjusted via an external device is disclosed. The circuit is designed to receive, after packaging, a plurality of adjustment inputs (20). These inputs are used by an adjustable voltage cell (21, 26, 71) to produce an adjustment factor. The adjustment factor will then be used by a voltage reference cell (22, 27, 72) to adjust the reference voltage (Vref).

15 Claims, 6 Drawing Sheets

| TRUTH TABLE | | | | | | |
|---|---|---|---|---|---|---|
| b0 | b1 | b2 | b3 | b4 | b5 | M |
| 1 | 1 | 1 | 1 | 1 | 1 | 1 |
| 0 | 1 | 1 | 1 | 1 | 1 | 1 + s2/s1 |
| 1 | 0 | 1 | 1 | 1 | 1 | 1 - s2/s1 |
| 1 | 1 | 0 | 1 | 1 | 1 | 1 + s3/s1 |
| 1 | 1 | 1 | 0 | 1 | 1 | 1 - s3/s1 |
| 1 | 1 | 1 | 1 | 0 | 1 | 1 + s4/s1 |
| 1 | 1 | 1 | 1 | 1 | 0 | 1 - s4/s1 |
| 0 | 1 | 0 | 1 | 1 | 1 | 1 + (s2+s3)/s1 |
| 1 | 0 | 1 | 0 | 1 | 1 | 1 - (s2+s3)/s1 |
| 0 | 1 | 0 | 1 | 0 | 1 | 1 + (s2+s3+s4)/s1 |
| 1 | 0 | 1 | 0 | 1 | 0 | 1 - (s2+s3+s4)/s1 |
| 1 | 1 | 0 | 1 | 0 | 1 | 1 + (s3+s4)/s1 |
| 1 | 1 | 1 | 0 | 1 | 0 | 1 - (s3+s4)/s1 |
| 0 | 1 | 1 | 1 | 0 | 1 | 1 + (s2+s4)/s1 |
| 1 | 0 | 1 | 1 | 1 | 0 | 1 - (s2+s4)/s1 |

FIG. 4

| TRUTH TABLE | | | | | | | |
|---|---|---|---|---|---|---|---|
| b0 | b1 | b2 | b3 | b4 | b5 | a1 | a2 |
| 1 | 1 | 1 | 1 | 1 | 1 | 0 | 0 |
| 0 | 1 | 1 | 1 | 1 | 1 | S2/S1 | 0 |
| 1 | 0 | 1 | 1 | 1 | 1 | 0 | S2/S1 |
| 1 | 1 | 0 | 1 | 1 | 1 | S3/S1 | 0 |
| 1 | 1 | 1 | 0 | 1 | 1 | 0 | S3/S1 |
| 1 | 1 | 1 | 1 | 0 | 1 | S4/S1 | 0 |
| 1 | 1 | 1 | 1 | 1 | 0 | 0 | S4/S1 |
| 0 | 1 | 0 | 1 | 1 | 1 | (S2+S3)/S1 | 0 |
| 1 | 0 | 1 | 0 | 1 | 1 | 0 | (S2+S3)/S1 |
| 0 | 1 | 0 | 1 | 0 | 1 | (S2+S3+S4)/S1 | 0 |
| 1 | 0 | 1 | 0 | 1 | 0 | 0 | (S2+S3+S4)/S1 |
| 1 | 1 | 0 | 1 | 0 | 1 | (S3+S4)/S1 | 0 |
| 1 | 1 | 1 | 0 | 1 | 0 | 0 | (S3+S4)/S1 |
| 0 | 1 | 1 | 1 | 0 | 1 | (S2+S4)/S1 | 0 |
| 1 | 0 | 1 | 1 | 1 | 0 | 0 | (S2+S4)/S1 |

FIG. 6

CIRCUIT AND METHOD FOR A PROGRAMMABLE REFERENCE VOLTAGE

BACKGROUND OF THE INVENTION

The present invention relates, in general, to electronics, and more particularly, to methods of forming semiconductor devices and structure.

In the past, the electronics industry utilized various methods and circuits to form a stable reference voltage. One example of such a circuit is often referred to as a band-gap reference circuit or band-gap regulator. One problem with prior reference circuits was errors in the value of the reference voltage. Often, the reference voltage had errors induced from various factors such as die stresses that resulted from mechanical stress applied to the semiconductor die from various sources such as stresses formed during packaging operations, thermal stress during operation, and other sources. Various attempts to correct reference voltages after packaging were attempted such as in-package trimming of resistors, opening fusible links, or zener zapping. Many techniques utilized metal migration techniques to adjust the reference voltage. Metal migration requires large currents and limited the locations where the target metal may be placed on the semiconductor die.

Accordingly, it is desirable to have a method of forming a reference voltage that reduces induced errors, that facilitates adjusting the value of the reference voltage after packaging and other manufacturing operations, and that does not require large currents to implement the adjustment.

BRIEF DESCRIPTION OF THE DRAWINGS

FIG. 4 is a truth table showing possible states and values of corresponding adjustment factors for an embodiment of the adjustable voltage reference of FIG. 3 in accordance with the present invention;

FIG. 6 is another truth table showing possible states and corresponding values of adjustment factors for an embodiment of the adjustable voltage reference of FIG. 5 in accordance with the present invention.

For simplicity and clarity of illustration, elements in the figures are not necessarily to scale, and the same reference numbers in different figures denote the same elements. Additionally, descriptions and details of well known steps and elements are omitted for simplicity of the description. As used herein current carrying electrode means an element of a device that carries current through the device such as a source or a drain of an MOS transistor or an emitter or a collector of a bipolar transistor, and a control electrode means an element of the device that controls current through the device such as a gate of an MOS transistor or a base of a bipolar transistor.

DETAILED DESCRIPTION OF THE DRAWINGS

The present description includes, among other features, a method of forming a system having an adjustable voltage reference including methods of forming the adjustable voltage reference that implements methods of adjusting the reference voltage after packaging and other manufacturing operations.

Figure 1:
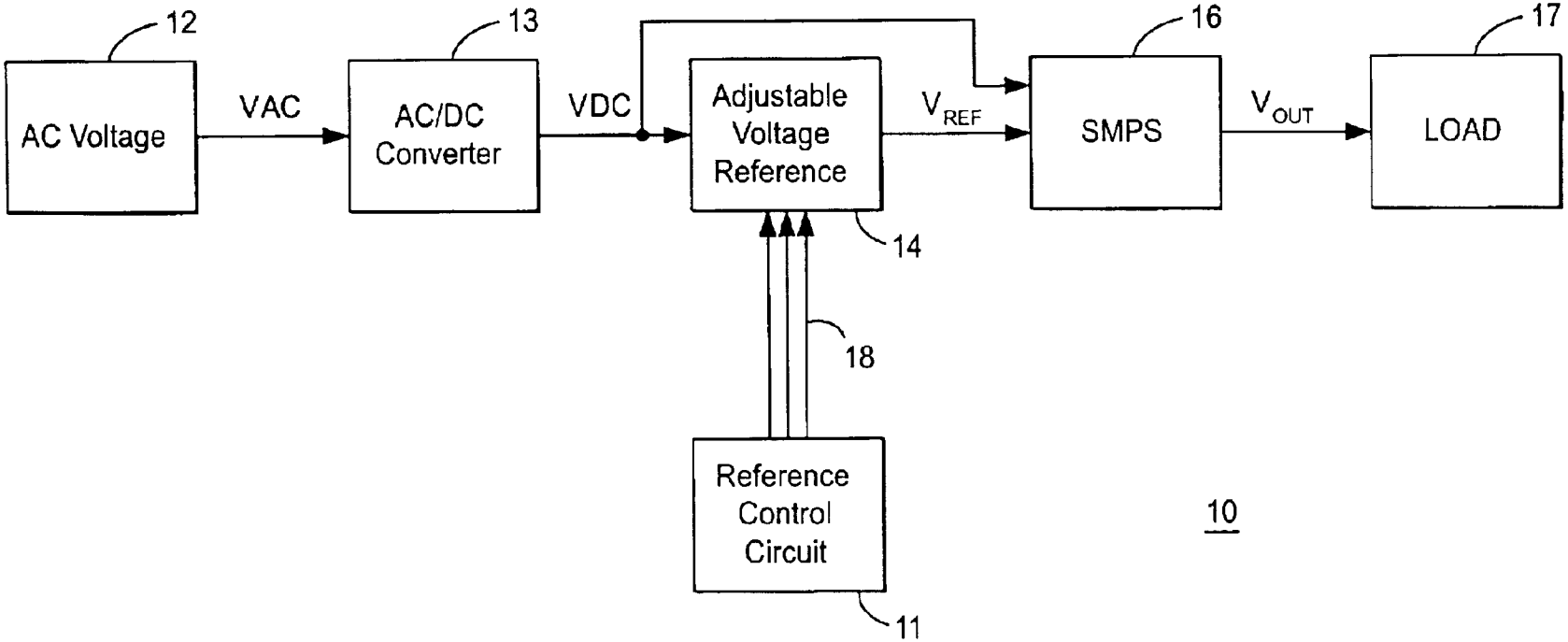
FIG. 1 schematically illustrates one example of an electrical system utilizing an adjustable voltage reference circuit in accordance with the present invention.

FIG. 1 schematically illustrates one example of an electrical system 10 in which an adjustable voltage reference may be used. Illustrated is an AC voltage source 12, an AC-to-DC (AC/DC) converter 13, an adjustable voltage reference 14, a reference control circuit 11, a switch mode power supply (SMPS) 16, and a load 17. In operation, AC voltage source 12, such as a household AC mains, supplies AC voltage (VAC) to AC/DC converter 13. In a typical embodiment, AC/DC converter 13 uses a diode bridge to convert the AC voltage to a rectified DC voltage or unregulated DC voltage (VDC). The unregulated DC voltage (VDC) supplies a DC potential to both adjustable voltage reference 14 and to switch mode power supply (SMPS) 16. Adjustable voltage reference 14 produces a stable reference voltage (Vref) that is supplied to SMPS 16. Adjustable voltage reference 14 is operable to adjust to changes in system 10 including changes in source 12 and converter 13 in addition to changes in reference 14 to maintain a stable value for the reference voltage (Vref). Such changes may result from various influences or factors including stress induced during manufacturing operations such as die packaging. Reference control circuit 11 provides output signals on outputs 18 that may be used to assist in adjusting the value of the reference voltage (Vref) to compensate for variations in the value of the output voltage (VOUT). Circuit 11 typically receives an error signal from SMPS 16 and provides the signals on outputs 18 in response to facilitate such adjusting. Circuit 11 may or may not be on the same semiconductor die with circuit 11 or in the same package with circuit 11. Circuit 11 may be a storage element or memory such as an electrically programmable read only memory (EPROM) or other type of control circuit.

Figure 2:
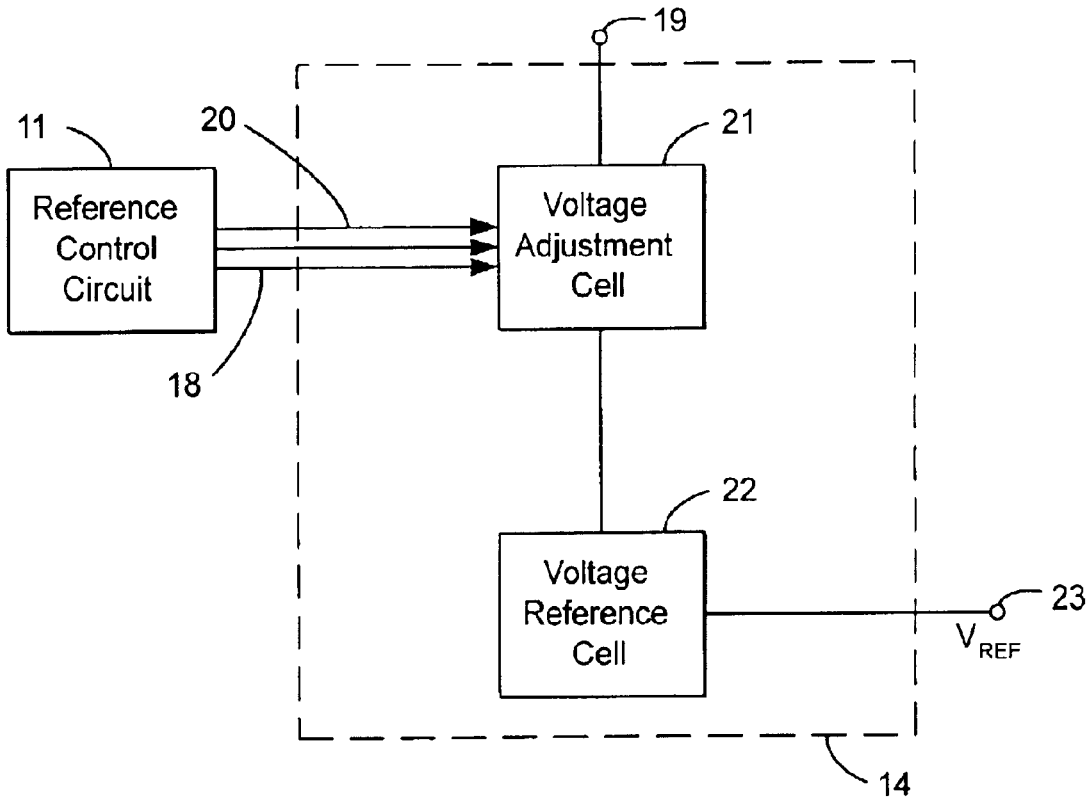
FIG. 2 schematically illustrates a block diagram of a portion of an embodiment of an adjustable voltage reference circuit in accordance with the present invention.

FIG. 2 schematically illustrates a block diagram of an embodiment of adjustable voltage reference 14 that is shown in FIG. 1. Illustrated are a voltage source input 19, a voltage adjustment cell 21, a voltage reference cell 22, and a reference voltage output 23. Reference control circuit 11 is also illustrated coupled to voltage adjustment cell 21 via a plurality of outputs 18 which are coupled to a plurality of inputs 20 of voltage adjustment cell 21. Outputs 18 provide signals indicative of adjustments to be made to the reference voltage Vref. Circuit 11 may be a variety of circuit implementations including a memory in which each memory location contains a value that is applied to outputs 18. In the preferred embodiment, circuit 11 is an electrically programmable read only memory (EPROM).

Voltage reference cell 22 establishes a reference current that is received by voltage adjustment cell 21. Cell 21 modifies the reference current based on the values of the information received from circuit 11 and provides an adjusted output current to cell 22. Cell 22 converts the adjusted current to the reference voltage Vref on output 23. In the preferred embodiment, voltage reference cell 22 includes a bandgap voltage reference circuit. When it is necessary to adjust Vref, such as after packaging the semiconductor die on which reference 14 is formed, adjustable voltage reference 14 is able to provide the needed adjustment to provide the desired value for Vref. Circuit 11 can be programmed to output values indicative of the voltage adjustment to be made. These values are sent as signals along outputs 18 to voltage adjustment cell 21.

Figure 3:
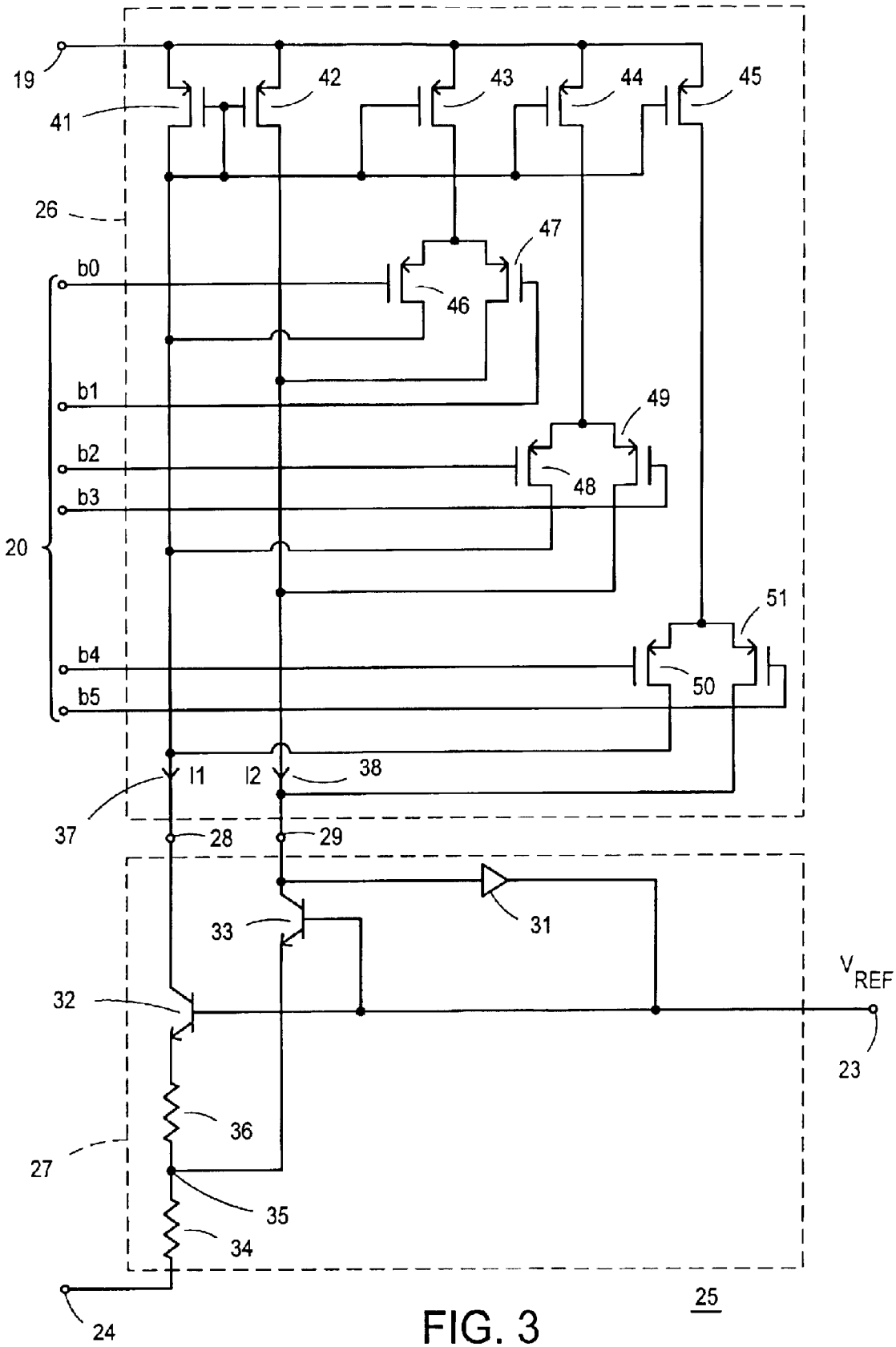
FIG. 3 schematically illustrates an embodiment of a portion of the adjustable voltage reference of FIG. 2 in accordance with the present invention.

FIG. 3 schematically illustrates an embodiment of a portion of an adjustable voltage reference 25 that is one embodiment of reference 14 shown in FIG. 2. Adjustable voltage reference 25 includes an adjustable current mirror 26 that functions similarly to voltage adjustment cell 21 (see FIG. 2) and a conversion circuit 27 that functions similarly to voltage reference cell 22 shown in FIG. 2. Adjustable current mirror 26 has a current input 28, a current output 29, a first series of transistors or a plurality of current source transistors 41–45 connected in a current mirror configuration, a second series of transistors or a plurality of switch transistors 46–51 connected as switches, and plurality of signal inputs 20, labeled b0–b5, coupled to transistors 46–51. Conversion circuit 27 includes a first conversion transistor 32, a second conversion transistor 33, resistors 34 and 36, and an error amplifier 31. Current input 28 is connected to the collector of transistor 32 which has resistors 34 and 36 connected between the emitter and a voltage return 24. Current output 29 is connected to the collector of transistor 33 that has an emitter connected to an intermediate node 35 of the voltage divider formed by resistors 34 and 36. The bases of transistors 33 and 32 are connected to output 23 and to an output of error amplifier 31. Amplifier 31 has an input connected to current output 29. Error amplifier 31 is a transconductance amplifier that forms a base voltage for transistors 32 and 33 that forces the collector current of transistor 33 to be approximately equal to a current 38. Any increase in the value of Vref causes the collector current of transistor 33 to increase more than the collector current of transistor 32 because the transconductance of transistor 32 is reduced by resistor 36. This reduces the value of the voltage at the input of amplifier 31 resulting in a corresponding decrease in the value of Vref. Any decrease in the value of Vref causes a corresponding change to correct the value of Vref. Thus, Vref is maintained substantially constant.

Transistor 32 establishes a reference current 37, illustrated by an arrow labeled as I1, through transistor 41. Mirror 26 receives reference current 37 and generates an adjusted output current or adjusted current 38, illustrated by an arrow labeled as I2. As will be seen hereinafter, the value of current 38 depends on the values of the size ratios of transistors 41–45 and the state of transistors 46–51. Thus, as will be see further hereinafter, mirror 26 has an adjustment factor or mirror factor (M) that relates to the ratio of the size of transistors 42, 43, 44, and 45 to the size of transistor 41. These transistor sizes determine the current flow for each transistor and the resulting adjustment current that is added to generate current 38. Thus, the mirror factor M is the ratio of the adjustment to current 38 that results from transistors 46–51 as specified by the value of the signals on inputs 20 to the value of reference current 37.

The value of reference voltage Vref can be determined as shown below:

$$V_{Ref} = V_{BE}^{Q1} + (I_1 + I_2)R_1$$

Given that:

$$V_t \ln\frac{I_1}{KI_s} + I_1 R_2 = V_t \ln\frac{I_2}{I_s} = V_t \ln\frac{MI_1}{I_s}$$

solving for $I_1$ :

$$I_1 = \frac{V_t \ln MK}{R_2}$$

where $I_s$ is the saturation current of transistors 32 and 33, $V_t$ is the thermal voltage of transistors 32 and 33, $V^{Q1}_{BE}$ is base to emitter voltage of transistor 33, K is emitter area ratio of transistor 32 to 33, and M is the mirror factor as will be explained hereinafter.

By substituting the above result into the equation for Vref, an expression for Vref in terms of the mirror factor (M) can be obtained:

$$V_{Ref} = V_{BE}^{Q1} + (M+1)\left(\frac{R_1}{R_2}\right)V_t \ln MK$$

Adjustable current mirror 26 has various current sources, such as transistors 41–45, and switch transistors, such as transistors 46–51, that form current 38 (I2). Transistors 41–45 each have a source coupled to voltage source input 19 and a gate coupled to the source of transistor 42. Transistor 41 has a drain coupled to input 28 to receive current 37. Transistor 42 has a drain coupled to output 29 to provide current 38. Transistors 42–45 establish mirror currents from current 37 and transistors 46–51 act as switches that apply the mirror currents to output current 38 in order to adjust the value of reference current 37 to produce current 38. Transistors 43–45 form a plurality of slave current source transistors that produce a current that is derived from current 37 and has a value that is determined by the mirror factor. The conductivity state of transistors 46–51 can be turned on and off via signals b0 through b5 received on inputs 20. Selectively turning on transistors 46 through 51 changes the mirror factor M thereby changing current 38 and the reference voltage on output 23. Transistors 41–45 are connected in a current mirror configuration and have desired width to length (W/L) ratios. As will be seen hereinafter, the W/L ratios of each transistor of transistors 41–45 is selected to provide desired mirror currents that will be added to current 38 to generate the adjusted value of current 38 and adjust the value of Vref. Typically, transistors 41 and 42 each have a W/L ratio that is equal and that is designated as S1 although other non-equal values may be used in other embodiments. Transistor 43 has a W/L ratio designated as S2, transistor 44 has a W/L ratio designated as S3, and transistor 45 has a W/L ratio designated as S4. The relationship of these ratios is described further in the description of FIG. 4. Associated with transistors 43–45 are switch transistors 46–51. Transistors 46 and 47 both have a source coupled to the drain of transistor 43, gates coupled to inputs 20 for receiving signals b0 and b1, respectively, and have a drain coupled to the drain of one of transistors 41 and 42, respectively. Transistors 48 and 49 both have a source coupled to the drain of transistor 44, gates coupled to inputs 20 for receiving signals b2 and b3, respectively, and have a drain coupled to the drain of one of transistors 41 and 42, respectively. Transistors 50 and 51 both have a source coupled to the drain of transistor 45, gates coupled to inputs 20 for receiving signals b4 and b5, respectively, and have a drain coupled to the drain of one of transistors 41 and 42, respectively. The signal applied to inputs 20 can be a series of ones and zeros where a one represents a high voltage level that turns-off any of transistors 46–51 and a zero represents a low voltage level that places any of transistors 46–51 in an on-state.

FIG. 4 is a truth table showing possible transistor states and corresponding adjustment factors for the embodiment where transistors 41 and 42 have the same width-to-length ratio. In other embodiments, transistors 41 and 42 may have different width-to-length ratios and the truth table will be different. Columns b0–b5 represents the state of corresponding inputs 20. A "1" represents a high voltage that turns-off the corresponding transistor having a gate connected to the input and a "0" is a low voltage that turns-on the transistor. Column "M" shows the corresponding mirror factor M that is the ratio of output current 38 to reference current 37. Since, in this embodiment, transistors 41 and 42 have the same width-to-length ratio, the ratio of the width-to-length ratios, or M, for these two transistors is shown as the value one (1). For this case, error amplifier 31 forces the collector current of transistor 33 to be approximately equal to the collector current of transistor 32. For example, when b0–b5 are all "1", all of transistors 46 through 51 are non-conductive and only transistors 41 and 42 operate to produce current 38 (I2) from current 37 (I1). Consequently, the truth table shows that the value of M for this example is one (1) and current 38 is current 37 multiplied by one. If b0 is a "0" and b1–b5 are "1', transistor 46 is turned on and there is a contribution to current 38 (I2) from transistor 43 having a width to length ratio of S2. In this case, the multiplication factor becomes (S1+(S2/S1)) or (1+(S2/S1)). The truth table illustrates other multiplication factors for other combinations of inputs 20 for the embodiment explained in the description of FIG. 3. Thus, the appropriate values for S1, S2, S3, and S4 establish the value of current 38 and the range of the mirror factor M which is then produced by the conductivity state of each of transistors 46 through 51. The ratios S1–S4 are chosen to provide a granularity of adjustments and a range that is desired for the application. For example, the ratios may be chosen to provide a binary weighting or other scheme. In the preferred embodiment, S1 is chosen to be one (1), S2 is chose to be one-half (0.5), S3 is chosen to be one-fourth (0.25), and S4 is chosen to be one-eighth (0.125). Finer or coarser adjustments can be provided by different ratios.

Figure 5:
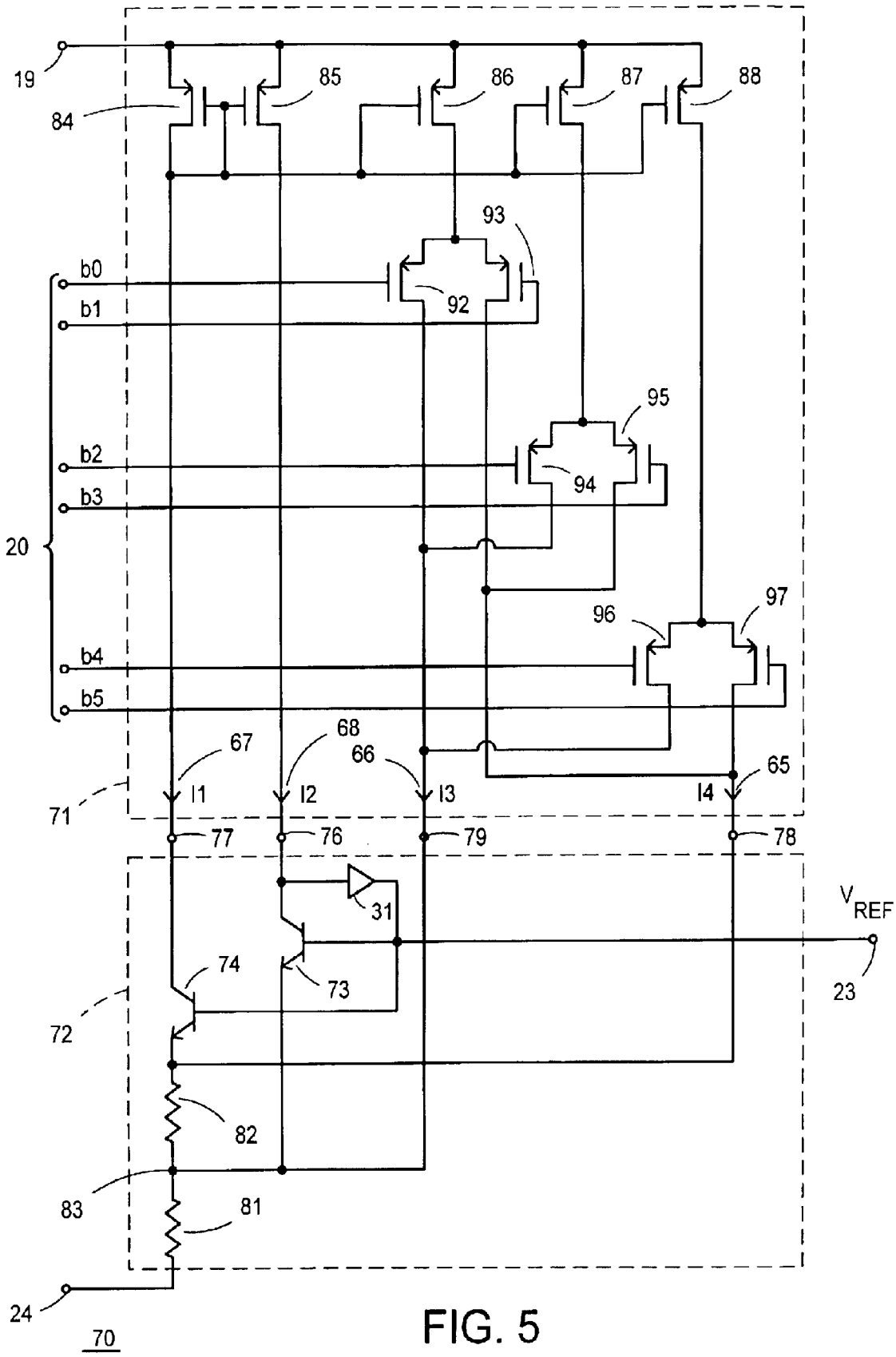
FIG. 5 schematically illustrates another embodiment of a portion of the adjustable voltage reference of FIG. 2 in accordance with the present invention.

FIG. 5 schematically illustrates a portion of an embodiment of an adjustable voltage reference 70 that is an alternate embodiment of reference 25 shown in FIG. 3. In this embodiment, Vref is adjusted by utilizing alternative current paths to adjust the reference voltage Vref. Reference 70 includes an adjustable current mirror 71 and a conversion circuit 72. Adjustable current mirror 71 has a current input 77, a current output 76, a first compensated current output 79, a second compensated current output 78, a first series of transistors or a plurality of current source transistors 84–88, a second series of transistors or a plurality of adjustment transistors 92–97, and plurality of signal inputs 20, labeled b0–b5, coupled to transistors 92–97. Transistors 86–88 form a plurality of slave current source transistors. Conversion circuit 72 includes a first transistor 74, a second transistor 73, resistors 81 and 82, and error amplifier 31. Error amplifier 31 is a transconductance amplifier that serves the same purpose as discussed in FIG. 3, thus, forms a base voltage for transistors 74 and 73 that forces transistor 73 to have a collector current that is approximately equal to current 68. Current input 77 is connected to the collector of transistor 74 which has resistors 81 and 82 connected between the emitter and return 24. Current output 76 is connected to the collector of transistor 73 that has an emitter connected to an intermediate node 83 of the voltage divider formed by resistors 81 and 82. The bases of transistors 73 and 74 are connected to output 23 and to an output of error amplifier 31. Amplifier 31 has an input connected to current output 76.

Transistor 74 establishes a reference current 67 through transistor 84, illustrated by an arrow labeled as I1. Mirror 71 receives reference current 67 and generates an output current 68, illustrated by an arrow labeled as I2 on output 76. Mirror 71 also generates a first adjusted current or first compensated current 66, illustrated by an arrow labeled as I3, on output 79 and a second adjusted current or second compensated current 65, illustrated by an arrow labeled as I4, on output 78. Depending on the combination of signals provided to current mirror 71 by inputs 20, adjusted currents 65 and 66 are formed that will raise or lower Vref. The adjusted current provided on outputs 79 or 78 depends on whether the adjustment is to increase or decrease the value of Vref. If the output of current mirror 71 will raise Vref, then the current will flow from output 79 to node 83. If the output of current mirror 71 will lower Vref, then the current will flow from output 78 to the emitter of transistor 74. As will be seen hereinafter, mirror 71 has mirror factors or adjustment factors referred to hereinafter as α. The value of currents 65 and 66 are the value of reference current 67 multiplied by the value of the adjustment factors (α). The value of alpha is determined from the ratios of current source transistors 84–88. Typically, transistors 84 and 85 have the same width-to-length ratio, thus, S1 has a value of one (1) and reference current 67 (I1) is approximately equal to output current 68 (I2).

In the case where Vref is to be increased reference 70 can be analyzed with the following equations:

$$V_{Ref} = V_{BE}^{Q1} + (I_1 + I_2 + \alpha I_1)R_1$$

since $I_1 = I_2$ $$V_{Ref} = V_{BE}^{Q1} + (2I_1 + \alpha I_1)R_1$$

and $$V_t \ln\frac{I_1}{KI_s} + I_1 R_2 = V_t \ln\frac{I_1}{I_s}$$

where $V_{BE}^{Q1}$ is the base-to-emitter voltage of transistor 73, α is the adjustment factor provided by adjustable current mirror 71 and shown in the truth table of FIG. 6, $I_s$ is the saturation current of transistor 73, $R_1$ is resistor 81, $R_2$ is resistor 82, and $V_t$ is the thermal voltage.

Solving for current, 67 (I1), and substituting back into the equation for Vref yields and equation for Vref:

$$V_{Ref} = V_{BE}^{Q1} + (2+\alpha)\left(\frac{R_1}{R_2}\right)V_t \ln k$$

For the case when Vref is to be decreased:

$$V_{Ref} = V_{BE}^{Q1} + (2I_1 + \alpha I_1)R_1$$

and $$V_t \ln\frac{I_1}{KI_s} + (I_1 + \alpha I_1)R_2 = V_t \ln\frac{I_1}{I_s}$$

Again, solving for I1 and substituting into the equation for voltage out yields an equation for reference voltage Vref:

$$V_{Ref} = V_{BE}^{Q1} + \left(\frac{2+\alpha}{1+\alpha}\right)\left(\frac{R_1}{R_2}\right)V_t \ln k$$

since the values of α will tend to be small, $$\frac{2+\alpha}{1+\alpha} \approx 2 - \alpha$$

Therefore,

-continued $$V_{Ref} \approx V_{BE}^{Q1} + (2-\alpha)\left(\frac{R_1}{R_2}\right)V_t \ln k$$

Thus, by choosing appropriate values for k and $\alpha$, the voltage Vref can be determined from the above equations. Variable k is the emitter area ratio of transistor 74 to 73. The value of $\alpha$ is determined by current mirror 71 as discussed hereinafter.

Adjustable current mirror 71 has various current sources, such as transistors 84–88, and switch transistors, such as transistors 92–97, that form output current 68 (I2) and adjustment currents 65 (I4) and 66 (I3). Transistors 84–88 each have a source coupled to input 19 and a gate coupled to a drain of transistor 84. Transistor 84 has a drain coupled to input 77 to receive current 67. Transistor 85 establishes a mirror current from current 67 and has a drain coupled to output 76 to provide current 68 from current 67. Transistors 86–88 establish mirror currents from current 67 and transistors 92–97 act as switches that apply the mirror currents to adjusted currents 65 and 66 to adjust the value of Vref. The conductivity state of transistors 92–97 can be turned on and off via signals b0–b5 received on inputs 20. Selectively turning on transistors 92–97 changes the adjustment factors a thereby changing adjusted currents 65 and 66 and Vref. Transistors 84–88 are connected in a current mirror configuration and have desired width to length (W/L) ratios. As will further be seen in the description of FIG. 5, the W/L ratios of each transistor of transistors 84–88 is selected to provide the mirror currents that will be added to adjusted currents 65 and 66. Typically, transistors 84 and 85 both have the same W/L ratio which is designated as S1 although other W/L ratios may be used. Typically, S1 has a value of one (1) although other values may be used. Transistor 86 has a W/L ratio of S2, transistor 87 has a W/L ratio of S3, and transistor 88 has a W/L ratio of S4. The relationship of S1–S4 to the currents is further discussed in the description of FIG. 6. Transistors 92 and 93 both have a source coupled to the drain of transistor 86, both have gates coupled to inputs 20 for receiving signals b0 and b1, respectively, and drains coupled to outputs 79 and 78 respectively. Transistors 94 and 95 both have a source coupled to the drain of transistor 87, both have gates coupled to inputs 20 for receiving signals b2 and b3, respectively, and drains coupled to outputs 79 and 78 respectively. Transistors 96 and 97 both have a source coupled to the drain of transistor 88, both have gates coupled to inputs 20 for receiving signals b4 and b5, respectively, and drains coupled to outputs 79 and 78 respectively. The signal applied to inputs 20 can be a series of ones and zeros where a one represents a high voltage level that turns-off any of transistors 92–97 and a zero represents a low voltage level that places any of transistors 92–97 in an on-state.

The conductivity state of transistors 92–97 determines the value of mirror factors or adjustment factors $\alpha_1$ and $\alpha_2$ that are shown in the equations in the description of conversion circuit 72 and in the truth table shown in FIG. 6. For example for the case of transistors 84 and 85 having the same width-to-length ratio, if transistor 92 is in the "on" state and all others are in the "off" state, transistor 86 will contribute to the adjustment factor $\alpha_1$, the contribution being a current having a value of ((S2/S1)×(I1)). If transistor 93 is in the "on" state, and all others are in the "off" state, transistor 93 will contribute to the adjustment factor $\alpha_2$, the contribution being a current having a value of ((S2/S1)×(I1)). Currents I3 and I4 introduce unbalanced currents into conversion circuit 72 which adjusts the base current to transistor 74 and the value of Vref to compensate for the unbalance. Thus, the choice of the size of transistors 84–88 establishes the possible range of the mirror factor or current adjustment factor while the conductivity state of transistors 92–97 produces the magnitude of the current adjustment factor.

FIG. 6 is a truth table showing possible transistor states and corresponding adjustment factors $\alpha_1$ and $\alpha_2$ for the embodiment where transistors 84 and 85 have the same width-to-length ratio (S1). Columns b0–b5 represents the state of corresponding inputs 20. A "1" represents a high voltage that turns-off the corresponding transistor having a gate connected to the input and a "0" is a low voltage that turns-on the transistor. Column $\alpha_1$ and $\alpha_2$ show the corresponding adjustment factors for adjustment currents 66 and 65, respectively, when transistors 84 and 85 have the same width-to-length ratio. In other embodiments, transistors 84 and 85 may have different width-to-length ratios and the truth table will be different. The truth table shown in FIG. 6 illustrates one possible set of combinations of transistor states and $\alpha_1$ and $\alpha_2$ values.

It should be noted that the voltage drop across mirror 71 is $[(V+)+V_{BE}-V_{Ref}]$. Thus, the voltage drop is low allowing mirror 71 to operate at a low supply voltages. Thus, voltage reference 70 and mirror 71 have an extra advantage of operating from low voltages.

In view of all of the above, it is evident that a novel device and method is disclosed. Forming the adjusted currents in response to the input signals facilitates adjusting the value of the reference voltage after the voltage reference is formed. This method additionally does not require large currents to provide the signals and adjustments thereby providing flexibility in the design of semiconductor die topology.

Although details of the circuits have been described a myriad of changes, variations, alterations, transformations and modifications may be suggested. For example FIGS. 3 and 5 illustrate six transistors for the current adjustment functions, transistors 46–51 and 92–97 respectively, however, the number of transistors is for illustrative purposes only and may vary to provide different degrees of adjustability. Additionally transistors 41–51 and 84–88, and 92–97 are illustrated as P-channel transistors however N-channel transistors or other types of transistors may be used. Additionally transistors 32–33 and 73–74 are illustrated as NPN transistors however PNP or other types of transistors may be used. It is intended that the circuit disclosed encompass such changes, variations, alterations, transformations and modifications and that they fall within the spirit and scope of the appended claims.

What is claimed is:

1. A method of forming a programmable reference voltage comprising:

coupling a plurality of current source transistors in a current mirror configuration including forming a master current source transistor of the plurality of current source transistors to have a first width-to-length ratio and forming a portion of the plurality of current source transistors as a plurality of slave current source transistors having a second width-to-length ratio that is different from first width-to-length ratio;

coupling the master current source transistor to receive a reference current;

coupling a first transistor of the plurality of slave current source transistors to the master current source transistor to generate an adjusted current having a value of the reference current multiplied by the first width-to-length ratio divided by a width-to-length ratio of the first transistor wherein the adjusted current is used to form a reference voltage.

2. The method of claim 1 further including coupling each transistor of the plurality of slave current source transistors to generate a current having a value of the reference current multiplied by the first width-to-length ratio divided by a width-to-length ratio of the plurality of slave current source transistors.

3. The method of claim 2 further including coupling a plurality of switch transistors responsive to a plurality of inputs to operably switch current from the plurality of slave current source transistors to the adjusted current.

4. The method of claim 1 further including coupling a band-gap reference circuit to receive the adjusted current and to generate the reference current that is received by the master current source transistor.

5. A voltage adjustment circuit for producing an adjusted reference voltage comprising:

a voltage adjustment cell having a current mirror circuit that includes a plurality of slave current source transistors, the current mirror circuit coupled to receive a reference current and responsively form an adjusted current that is proportional to the reference current, and coupled to receive a plurality of input signals representing a desired adjustment factor and responsively couple a portion of the plurality of slave current source transistors to change the adjusted current based on the received adjustment factor; and a voltage reference cell coupled to the voltage adjustment cell and operable to produce a reference voltage, the voltage reference cell further operable to receive the adjusted current from the voltage adjustment cell and responsively produce the adjusted reference voltage based on the reference voltage and the adjusted current.

6. The voltage adjustment circuit of claim 5 wherein the adjusted current is equal to the reference current times the adjustment factor.

7. The voltage adjustment circuit of claim 5 wherein the current mirror circuit comprises a plurality of transistors coupled to the plurality of input lines wherein a conductivity state of each of the plurality of transistors is determined by the plurality of input signals received on the plurality of input lines, and wherein the conductivity state of the plurality of transistors produces the current adjustment factor.

8. The voltage adjustment circuit of claim 5 wherein the current mirror circuit comprises a plurality of transistor, including said plurality of slave current source transistors, each with a width-to-length ratio wherein the width-to-length ratio of the plurality of transistors establishes the adjustment factor and wherein a first transistor of the plurality of transistors has a first width-to-length ratio that is different from a second width-to-length ratio of a second transistor of the plurality of transistors.

9. The voltage adjustment circuit of claim 5 wherein the voltage reference cell further comprises a transconductance amplifier coupled to receive the adjusted current and responsively form the reference voltage.

10. The voltage adjustment circuit of claim 9 wherein the voltage reference cell further comprises a first transistor operable to receive the reference voltage and responsively form the reference current, and a second transistor operable to receive the reference voltage and the adjusted current and form an input voltage to the transconductance amplifier.

11. A method of forming an electrical system providing an output voltage to a load comprising:

coupling an adjustable current mirror circuit of a voltage adjustment cell to receive a plurality of signals and in response thereto selectively couple at least a portion of a plurality of slave current source transistors to produce a current adjustment factor and coupling the adjustable current mirror circuit to receive a reference current and generating an adjusted current determined by multiplying the reference current by the current adjustment factor;

coupling a voltage reference cell to the voltage adjustment cell wherein a reference voltage of the voltage reference cell is adjusted in response to the current adjustment factor; and coupling a power supply to receive the reference voltage from the voltage reference cell and produce the output voltage.

12. The method of claim 11 wherein coupling the adjustable current mirror circuit includes coupling the plurality of slave current source transistors wherein a conductivity state of the plurality of slave current source transistors is determined by the plurality of signals and wherein the conductivity state of the plurality of slave current source transistors determines the current adjustment factor.

13. The method of claim 11 wherein coupling the adjustable current mirror circuit includes coupling the plurality of slave current source transistors each with a width-to-lenghth ratio, and wherein the current adjustment factor is a function of the width-to-lenghth ratio of the plurality of slave current source transistors.

14. The method of claim 11 wherein coupling the adjustable current mirror circuit to operably receive the plurality of signals and produce the current adjustment factor includes forming the current adjustment factor by a size of transistors in an adjuster circuit.

15. The method of claim 11 further including operably coupling a storage element to produce the plurality of signals.

* * * * *